US009737130B1

(12) United States Patent
Frontino

(10) Patent No.: US 9,737,130 B1
(45) Date of Patent: Aug. 22, 2017

(54) PAINT CAN RECEIVING WRIST SLEEVE WITH ADDITIONAL ATTACHMENT POINTS

(71) Applicant: Justin Michael Frontino, Porter, TX (US)

(72) Inventor: Justin Michael Frontino, Porter, TX (US)

( * ) Notice: Subject to any disclaimer, the term of this patent is extended or adjusted under 35 U.S.C. 154(b) by 0 days.

(21) Appl. No.: 15/175,167

(22) Filed: Jun. 7, 2016

(51) Int. Cl.

| | |
|---|---|
| ***B44D 3/14*** | (2006.01) |
| ***A45F 5/00*** | (2006.01) |
| ***B44D 3/12*** | (2006.01) |
| ***A41D 13/08*** | (2006.01) |

(52) U.S. Cl.
CPC ..... *A45F 5/00* (2013.01); *A41D 13/088* (2013.01); *B44D 3/123* (2013.01); *B44D 3/14* (2013.01); *A45F 2005/008* (2013.01)

(58) Field of Classification Search
CPC ..... B44D 3/14; A45F 2005/008
USPC ..... 224/218; 294/25
See application file for complete search history.

(56) References Cited

U.S. PATENT DOCUMENTS

| | | | | |
|---|---|---|---|---|
| 1,463,977 | A | | 8/1923 | Smith |
| 2,026,536 | A | | 1/1936 | Hothersall |
| 2,547,096 | A | | 4/1951 | Sawyer |
| 2,717,109 | A | | 10/1952 | Walsh |
| 2,626,737 | A | | 1/1953 | Pitz |
| 2,687,865 | A | | 8/1954 | Young |
| 2,995,281 | A | | 5/1958 | Dixon |
| 3,131,900 | A | | 5/1964 | Anderson |
| 4,569,449 | A | | 2/1986 | Brent |
| 4,736,488 | A | | 4/1988 | Nielsen |
| 4,895,269 | A | | 1/1990 | Cade |
| 4,993,767 | A | | 2/1991 | Song |
| 5,020,710 | A | | 6/1991 | Meszaros |
| 5,092,481 | A | | 3/1992 | Skelton |
| 5,217,193 | A | | 6/1993 | Drucker |
| 5,251,781 | A | * | 10/1993 | Skelton ..... B65D 25/32 220/755 |
| 5,471,681 | A | * | 12/1995 | Ferrini ..... A41D 19/01594 2/160 |
| 5,497,921 | A | | 3/1996 | Dancyger |
| 5,511,753 | A | | 4/1996 | Lage |
| 5,570,807 | A | | 11/1996 | Busch |
| 5,806,709 | A | | 9/1998 | Marshall, II |
| 6,000,058 | A | | 12/1999 | Iselin |
| 6,135,310 | A | | 10/2000 | Svehaug |
| 6,382,691 | B2 | | 5/2002 | Hazelton |
| 6,394,304 | B1 | | 5/2002 | Bohne |
| D465,578 | S | | 11/2002 | Friedrich et al. |

(Continued)

*Primary Examiner* — Justin Larson
(74) *Attorney, Agent, or Firm* — William C. Yarbrough, III

(57) ABSTRACT

A device and method for one-handed securing and controlling of a container with decreased stress and pressure upon the thumb, wrist, forearm and hand of the user. The device utilizes an attached spring-activated swivel gate hook to engage the semi-circular bale handle of a can in various positions that allow for maximum control and flexibility in the manipulation of the container combined with the freedom to adjust the grip of the can without giving up the option to work with both hands. The weight of the can, is in all situations, is equally distributed and centered at the point of flexion of the wrist. Ease of movement is accomplished while supporting the hand, wrist and lower forearm of the user.

11 Claims, 9 Drawing Sheets

(56) References Cited

U.S. PATENT DOCUMENTS

| | | | | |
|---|---|---|---|---|
| 6,658,701 | B1 | 12/2003 | DeHart | |
| 6,708,838 | B2 | 3/2004 | Bergman | |
| 6,851,571 | B1 | 2/2005 | LaLonde | |
| 6,863,191 | B2 | 3/2005 | Kesling | |
| 6,865,748 | B2 | 3/2005 | Young | |
| 6,991,829 | B2 | 1/2006 | Bergman | |
| 7,073,205 | B2 | 7/2006 | Finn | |
| 7,387,323 | B1 | 6/2008 | Minnette | |
| D633,215 | S * | 2/2011 | Steele | D24/190 |
| 7,959,030 | B2 | 6/2011 | Berman | |
| 8,286,825 | B2 * | 10/2012 | Billado, Jr. | B44D 3/127 220/762 |
| 8,413,839 | B2 | 4/2013 | Horvath | |
| 8,919,713 | B2 | 12/2014 | Reusser | |
| 9,345,291 | B2 * | 5/2016 | Brenner | A44C 5/0007 |
| 2002/0125385 | A1 | 9/2002 | Tweed | |
| 2002/0145001 | A1 | 10/2002 | Morelock | |
| 2003/0024959 | A1 | 2/2003 | Armstrong | |
| 2005/0193463 | A1 * | 9/2005 | Finn | A41D 19/0037 2/160 |
| 2006/0016841 | A1 | 1/2006 | Shurm | |
| 2009/0050657 | A1 | 2/2009 | Woolery | |
| 2014/0124520 | A1 | 5/2014 | Allan | |

* cited by examiner

PAINT CAN RECEIVING WRIST SLEEVE WITH ADDITIONAL ATTACHMENT POINTS

BACKGROUND OF THE INVENTION

Field of the Invention

The present invention relates to an sleeve designed to fit about the hand, wrist, and forearm and to aid in the holding and control of a container, and more particularly, to an improved adjustable wrist sleeve constructed to receive and attach to a cylindrical container displaying a semi-circular bale handle, allow for single-handed container control, and provide a point of attachment for a paint brush and a communication device.

Background of the Invention

It has long been customary for painters to engage in detailed painting and trim work that involves using precise techniques to discretely apply paint to the borders and edges of painted walls. While some work is required along the baseboard (at the intersection of floor and wall), the majority of trim work and "cutting in" is accomplished where wall meets wall, wall meets ceiling and at the point where the wall meets a framed opening such as a window or a door. Irrespective of location, residential and commercial painters alike utilize the universal technique of a single-handed grip of a bale-handled paint can where the four terminal digits (fingers) of the hand are used to support the base of the can while the opposable pollex or thumb is flexed at the distal interphalangeal joint to "hook" the thin can bale handle at the point where the handle is at a position that is in close proximity to, but not completely rested on, the side of the can. This technique is helpful in giving the painter the maximum amount of accessibility to the desired paint while allowing for a one-handed grip that provides control of the container in its original packaging—negating the need to transfer the paint into another receptacle to facilitate transportation to the desired location. This use of the original can is expedient and conservative of paint. Unfortunately, it is this type of "precision grip" that leads to an untenable stress upon the receiving hand, the lower and upper arm of the painter, and into neck and upper back—leading to a truly unsustainable strain and resulting muscle cramping and fatigue. Habitual repetitive utilization of this technique can and will result in a Repetitive Strain injury (RSI) marked by long term musculoskeletal and neurological damage to the fingers, wrist, arm, shoulder, and neck. It is this arm and hand lassitude and resulting potential for long-term damage that necessitates an improved means of paint can grip.

As mentioned above, it is commonplace to use the unassisted gripping technique of holding a paint can to the ultimate detriment of the muscles, joints, and neurons of the painter's hand, wrist, arm and shoulder. The painter, in order to grasp and manipulate the paint can, must choose the archaic and pedestrian, yet practical, technique of a sustained precision grip—all to the overall disservice to his primary tool: his hands. Yet, while several designs and assemblages have been developed to address the need for improved paint can handling, all systems essentially fail on one of 2 points: (1) concept and (2) overall utilization. Fundamentally, the problem posed to the painting industry necessitates a paradigm shift to address the inadequate solutions to an extremely pressing need.

Conceptually, several inventors have sought various solutions to the overall placement of the bale-handled paint can for support and ease of access by the painter. Spatially, this can be seen through inventions that bring the paint can ever closer to the painter in an attempt to allow increasing ease of access to the can's paint while decreasing the need for excessive paint can manipulation. This is evidenced through 3 distinct attachments, each with varying degrees of success.

Paramount in this field is can attachment directly to a painter's ladder (See Anderson, U.S. Pat. No. 3,131,900, Brent, U.S. Pat. No. 4,569,449, and Reusser U.S. Pat. No. 8,919,713). As depicted in each of these patents, the paint can is reversibly affixed to the ladder of the painter at various sites with differing degrees of access. Unfortunately, this placement creates a natural shift in the center of gravity of the ladder (and the painter/ladder combination) creating the supposition of a shift in the overall stability of the combination and a potential for a painter's fall and paint spillage. Moreover, the ladder attachment necessitates a close distance between ladder and painter with a resulting limitation on work area, proximity to paint, and painter maneuverability.

In keeping with the theme of paint adjacency, inventors Walsh (U.S. Pat. No. 2,717,109), Dixon (U.S. Pat. No. 2,995,281) and Dancyger (U.S. Pat. No. 5,497,921) each addressed and overcame the distance gap created with a fixed connection to a stationary object (a ladder) by harnessing and attaching the paint can to the painter's person. As can be seen in each of the above examples, the aforementioned inventors individually and collectively envisioned inventions that affixed paint can to painter. Although, it is clear in each invention that the immediacy of the paint can allows for an ease of access to the paint and an increased range of work mobility, the inventions in the '109, '281, an '921 patents are nonetheless cumbersome and unergonomic. So, while these patents enhance immediacy to the paint they continue to be an untenable solution to can and paint management and manipulation. Equally, the attachment in each of these patents carry with them an ever present risk of paint loss due to painter movement and gyration.

A result of the natural result and solution to the aforementioned shortcomings of detached and attached paint can management and immediacy is the hand and wrist attachment of paint can to painter. Undeniably, can handles and holders have received the lion's share of attention for inventions postulated to solve both the discussed issues of proximity and ease of can manipulation with varying degrees of success. Hothersall (U.S. Pat. No. 2,026,536) describes a rudimentary pale handle guard designed to increase the surface area of the pale handle and aid in grip and comfort. Unfortunately, while solving the issue of proximity, this is a small improvement upon a naked grip and fails to address ease of manipulation and hampers brush access. Equally, as depicted in U.S. Pat. No. 2,547,096 by Sawyer and U.S. Pat. No. 4,895,269 by Cade, a basic and attachable can handle can be seen to allow for single-handed attachment and manipulation without being permanently affixed or attached to the painter. And while this solves proximity issues while negating restricted brush access, it does little to address hand and grip fatigue. Too, as shown in U.S. Pat. No. 5,092,481 issued to Skelton, access and manipulation are addressed with a loop about the bale-handle of the paint can which is made to receive the thumb of the painter and allowing for unfettered access to the paint. The point of attachment is an enhancement over previous attempts to facilitate access and can manipulations and comes nearer to a functional design. But, while this answers issues with distance and brush accessibility, it fails to relieve stress on the thumb and requires a sustained grip thus not solving the issues of hand/wrist fatigue.

Recognizably, improvements on the basic single-hand can grip have been made. As depicted in U.S. Pat. No. 5,806,709 issued to Marshall II, the rudimentary inventions of basic attachment have given way to an invention that attempts to place the hand in a more natural position. As displayed in the '709 patent, the pale bale-handle is controlled by the depicted devise which also supports the can base while receiving the painter's thumb. However, the thumb placement is a simple adjustment to prior efforts and does not remove the thumb from the stress equation all while leaving the critical component of decreased thumb stress absent. Additionally, variations also exists in the related area of hand position that facilitate a more natural grip and manipulation of a paint can. As enumerated in U.S. Pat. No. 8,413,839 issued to Horvath, the '839 invention proffers an invention designed to more naturally follow the contours of the painter's hand. In the several positions available to the painter with the disclosed device, each relies upon the thumb to either grip or secure the paint can in an unattached, untethered position, inopposite to the present invention's safeguarded attachment. Although, the system does address the issue of thumb stress and wrist and arm fatigue, it fails to properly take into account the devices preclutivity to shifting and untoward movement. U.S. Pat. No. 7,073,205 issued to Finn has sought to overcome the deficiencies of Horvath's device by incorporating stationary attachment into Horvath's invention. Finn too incorporates decreased dependence upon the thumb into his "glove" that is sewn directly onto a sleeve which surrounds and partially enfolds a paint can. Finn, though fails to take into consideration the lack of control created with such an unbalanced arrangement and the complete loss of the use of the hand used in Finn's proffered resolution. What's more, while Finn's invention may have the capability to lessen the stress experienced by the thumb, it has greatly increased the tension realized by the wrist in such an arrangement—a detraction quintessentially affecting the overall utility of the invention.

Finally, wide-ranging modes and complex arrangements have been incorporated into inventions that seek to address the need for single-handed paint can manipulation and equally addresses the issues of hand and wrist stress. Too, interior access to the paint can is a crucial element that cannot be discounted. U.S. Pat. No. 5,471,681 (Glove Having a Hook for Steadily Holding a Container) as discussed by Ferrini, comes closest to improving upon the infirmities of previous inventions by developing an apparatus that allows for attachment to the bale-handle of a paint can with reduced pressure on the thumb and wrist of the operator. Indeed, Ferrini's '681 invention is a marked development and improvement over the ladder-attached and painter-affixed patents heretofore discussed. Too, the Ferrini patent provides more stabilization and less thumb stress than that of the solution proposed by Skelton's thumb loop (U.S. Pat. No. 5,092,48). Equally, the '681 invention progresses past both the loosely affixed placement, thumb stabilized '709 and '839 patents, issued to Marshall II and Horvath respectively, and the less permanent and wrist taxing invention of the patent issued to Finn (U.S. Pat. No. 7,073,205) in terms of not only point of attachment, but also thumb stress and weight distribution. Nevertheless, Ferrini's patent falls short of the present invention on several key points. Primarily, the present invention is an improved design over the '681 patent in that the placement and closing ability of the swivel gate snap hook places the pull of the bale handle more naturally on the painter's wrist (versus the painter's palm) and the ability to releasably attach and reattach the hook gives way to an increased range of motion that allows for canister control with (1) the hook at the bale handle's apex, the bale handle in a downward position, and the fingers resting on the bottom of the can, (2) the hook at the point of connection and pivot to the canister, the bale handle in a downward position, and the fingers and thumb resting to the side of the canister, and (3) the gate snap hook at the apex of the bale handle where the bale handle is extended up and away from the canister in a "carrying position" where the painter's hand is free and the canister is allowed to rotate in a 360 degree swivel. Further improvements include freely moveable and engagable digits and thumb, increased wrist and upper arm support, and inner wrist stabilization sleeve, a padded comfort strip, and 3 elastic hook-type fastener tabs designed for adjustment (i.e. tightening and loosening) of the brace, additional elastic bands for a communication device, and a magnet that is sewn into the wrist sleeve for paint brush attachment. It is these points of differentiation that are of paramount importance to the utility of the present invention and provide a novel, non-obvious invention for paint can attachment and control.

While many endeavors exist to secure a paint can to a painter's hand and wrist without restricting paint access or mobility, none yet has accomplished this in a manner that allows the painter to maintain complete control over the attached can, freely moveable, from various positions and angels without undue tension upon the hand and wrist. This invention seeks to resolve the issue of allowing a painter consistent control and manipulability of a paint can in the form of an ergonomic, adjustable paint can attachment system that is both practical and comfortable.

BRIEF SUMMARY OF THE INVENTION

The present invention relates to a means of offering an improved method for providing single-handed control of a semi-circular, bale handled paint canister while simultaneously decreasing the stress and strain of repetitive strain injury to the thumb, wrist, hand or forearm of the operator. In the broadest embodiment, the present invention is a wrist sleeve consisting of a primary u-shaped body, a circular opening for the insertion of a thumb, an elastic arm-fixing inner sleeve, securing tabs for the closure of the wrist sleeve, and a freely rotatable gate snap hook for attachment to a paint can bale handle. When the hand and wrist are inserted into the sleeve and the tabs are secured in a fixed position about the wrist and lower portion of the forearm, each to the opposite ridge, the affixed swivel spring hook can be made to accept a paint can bale handle that allows for bale handle acceptance while preventing unassisted release.

In a preferred embodiment, the adjustable wrist sleeve forms a u-shape (e.g. a taco) that is made to receive the user's hand, wrist and the distal forearm (comprised of the lower portion of the radius and ulna) in an conformable format where the thumb is accepted through a circular aperture that is bisected by the u-shape's vertical axis. This aperture is located nearest the distal end of the wrist sleeve and serves to receive the thumb and to halt the movement of the wrist sleeve proximally toward the user's elbow. With the wrist sleeve in a thumb down placement and the dorsal portion of the hand facing the user, the medial upper ridge of the invention closest to the operator can be seen to exhibit two hook-fastener tabs with active securing portion facing out and away from the user that are made to reversibly adhere to the opposite side of the device's loop fastening material. The lateral upper ridge of the opposite side contains one elongated strap with a hook-type faster tab that is designed to traverse the area between the medial tabs, stretch across the device transversely, and be made to come into contact with a same loop-type material of the originating device side. The resulting communications, each with the opposed ridge, creates a cylindrical encapsulation of the palm of the hand, wrist, and lower forearm. These loop and hook tabs can be adhered, adjusted, and readhered to the receiving surface to adjust and readjust the wrist sleeve in accordance with varying wrist and arm circumferences and girths. A swivel gate snap hook is sewn into the palmer side of the wrist sleeve (as viewed with thumb pointing inward toward the body, hand pronated, and gate snap hook pointing downward) for secured attachment to the bale handle of a paint can that is downwardly rotated toward the paint can side. This swivel hook is purposefully located at the point of wrist flexion for uniform distribution of the pulling weight of the paint canister and at the point aiding in the greatest degree of control and manipulation of the paint can. In this embodiment the gate snap hook is made to engage the bale handle at an angle where the palm is facing up, the bale handle is downwardly positioned close to the side of the container, the fingers rest on the bottom of the paint container, and the thumb is positioned on the side of the container for maximum can control.

The present invention also provides a method for attachment of the wrist sleeve to the paint can where the swivel gate hook is engaged to the bale handle of a paint can at the point of attachment to the paint can (i.e. the point of pivot) and the fingers and thumb are placed about the paint can thereby securing the paint can in a side grip manner.

The invention provides yet another method of use in where the gate hook is affixed to the bale handle at the apex of the handle while the paint can is allowed to hang loosely using the weight of the can to center the gate hook and thereby allowing the painter to use the can-attached hand freely while maintaining the freely-swiveling can in an attached orientation allowing the painter to freely work with both hands.

In another embodiment of the present invention the wrist sleeve maintains a padded insert, sewn onto the underside of the wrist sleeve, extending the length of the medial portion of the wrist sleeve, and tapered at the sleeve edges that is located under the swivel gate hook and serves as the anchor for the hook. This padded insert extends above and below sleeve plane to support the wrist interiorly and serve as a barrier between paint can bottom and operator's wrist exteriorly. This padding runs longitudinally and can be best visualized as the user holds the invention in a supine position with the swivel gate hook resting entirely upon the padding and the padding operating as a barrier between canister bottom edge and painter's hand.

In another embodiment of the present invention the painter's sleeve exhibits a magnet that is permanently fixed to the dorsal portion of the invention and made stationary through a covering with material that is stitched around the perimeter of the magnet and made to encapsulate the magnet. This magnet is designed and specifically placed to communicate with the metal portion of a paint brush (the ferrule) or other metallic object for the attachment and adherence of the brush when not in use.

In yet another embodiment of the invention an elastic securing means is present which runs transversely at the portion of the sleeve most proximal to the painter. This securing means is expandable and retractable with loop and hook fastening means that can easily attach and reattach to the loop-type surface of the wrist sleeve and can be utilized to fasten a communication device or portable media player such as an I Phone® or an I Pod® to the wrist sleeve.

DETAILED DESCRIPTION OF THE INVENTION

The following detailed description is of the best currently contemplated modes of carrying out exemplary embodiments of the present invention. The description is not to be taken in a limiting sense, but rather is made merely for the purpose of illustrating the general principles of the invention, since the scope of the invention is best defined by the appended claims and diagrams.

Figure 6:
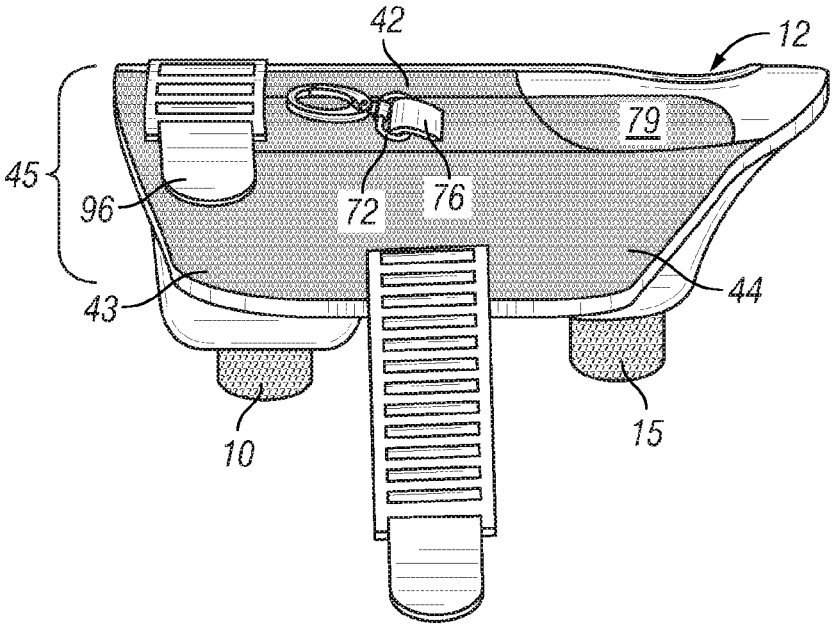
FIG. 6 is a right side view of the present invention in an open orientation.
Figure 7:
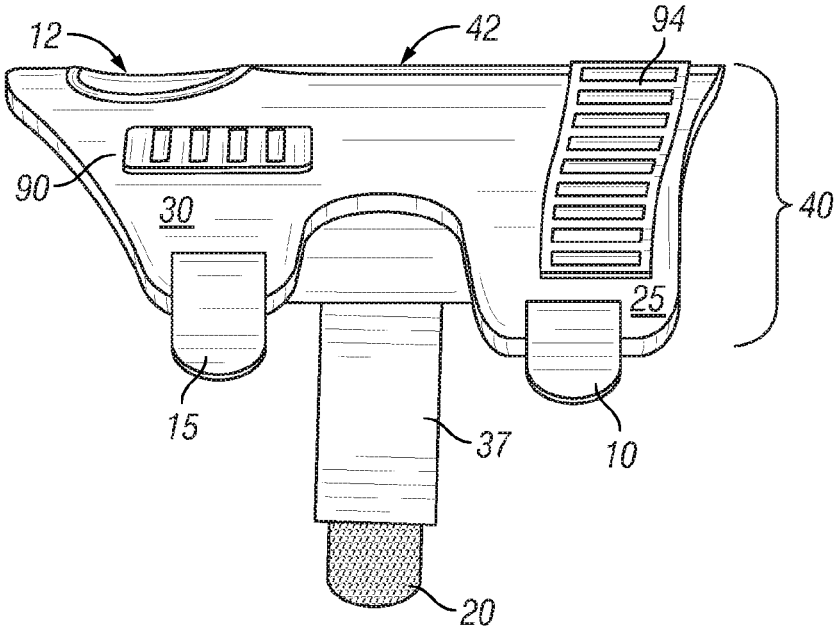
FIG. 7 is a left side view of the present invention in an open orientation.
Figure 8:
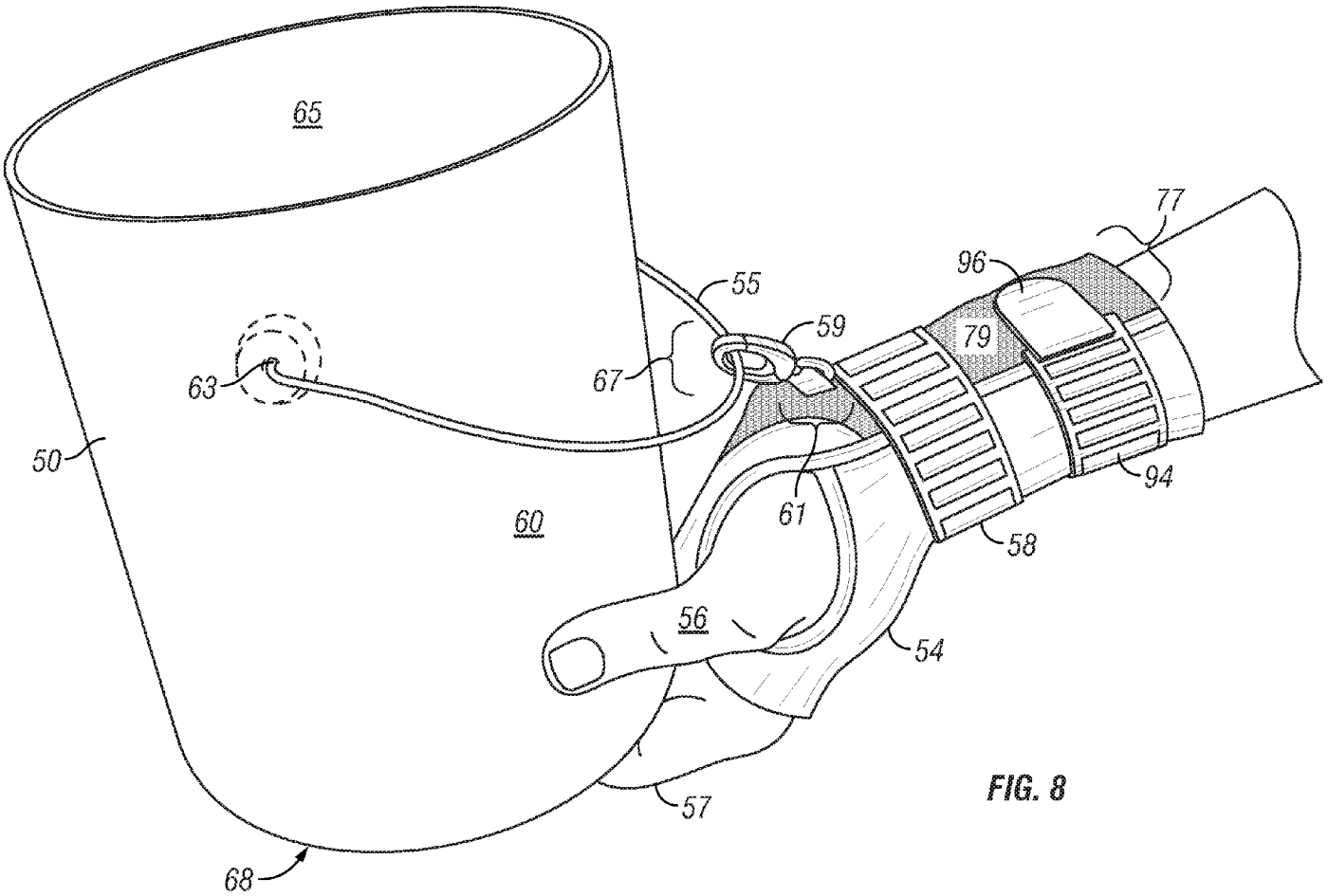
FIG. 8 is a side perspective view of the present invention where the means for wrist sleeve attachment is secured to the apex of the bale handle, the bale handle is made to rest alongside of the paint can, the thumb is on the side of the paint can, and the fingers support the base of the paint can.
Figure 9:
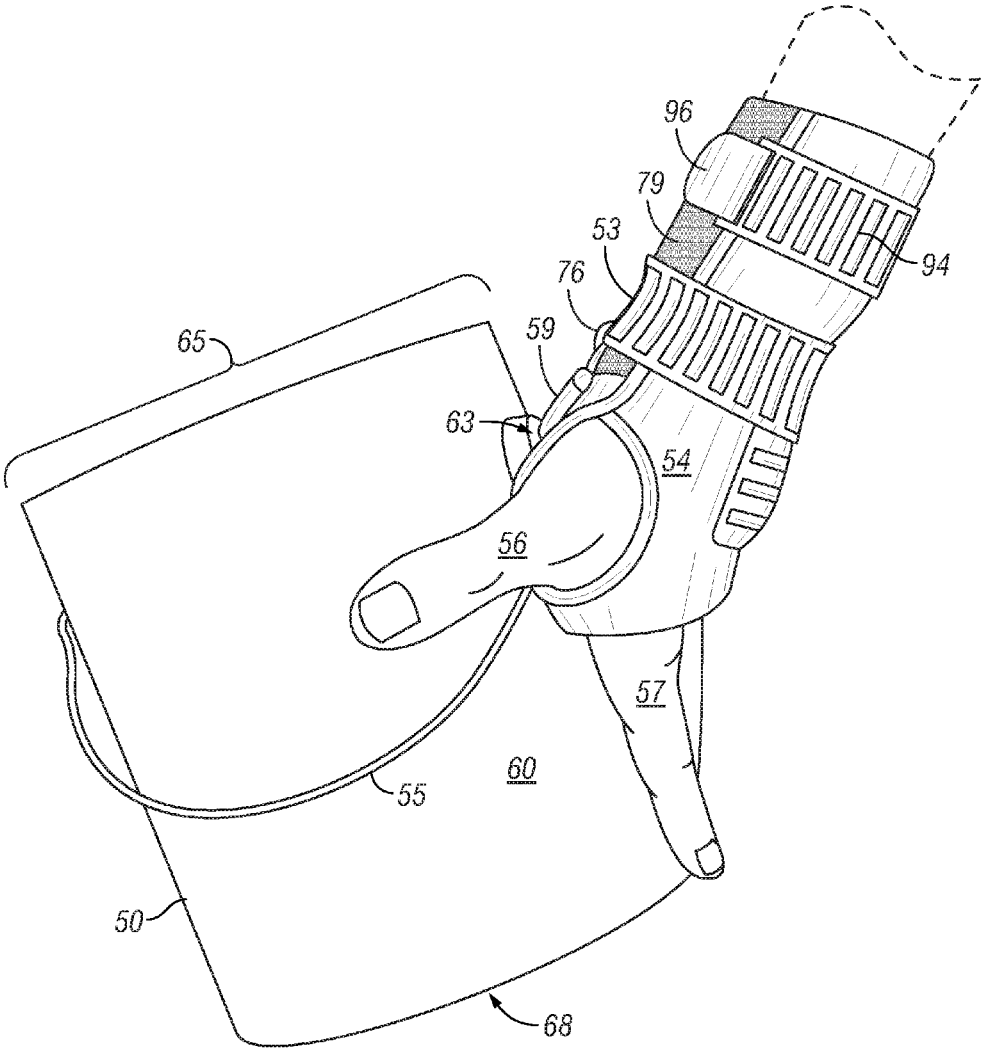
FIG. 9 is a side perspective view where the means for wrist sleeve attachment is linked to the point of connection of semi-circular bale handle to paint can and both thumb and fingers are on the side of the paint can.
Figure 10:
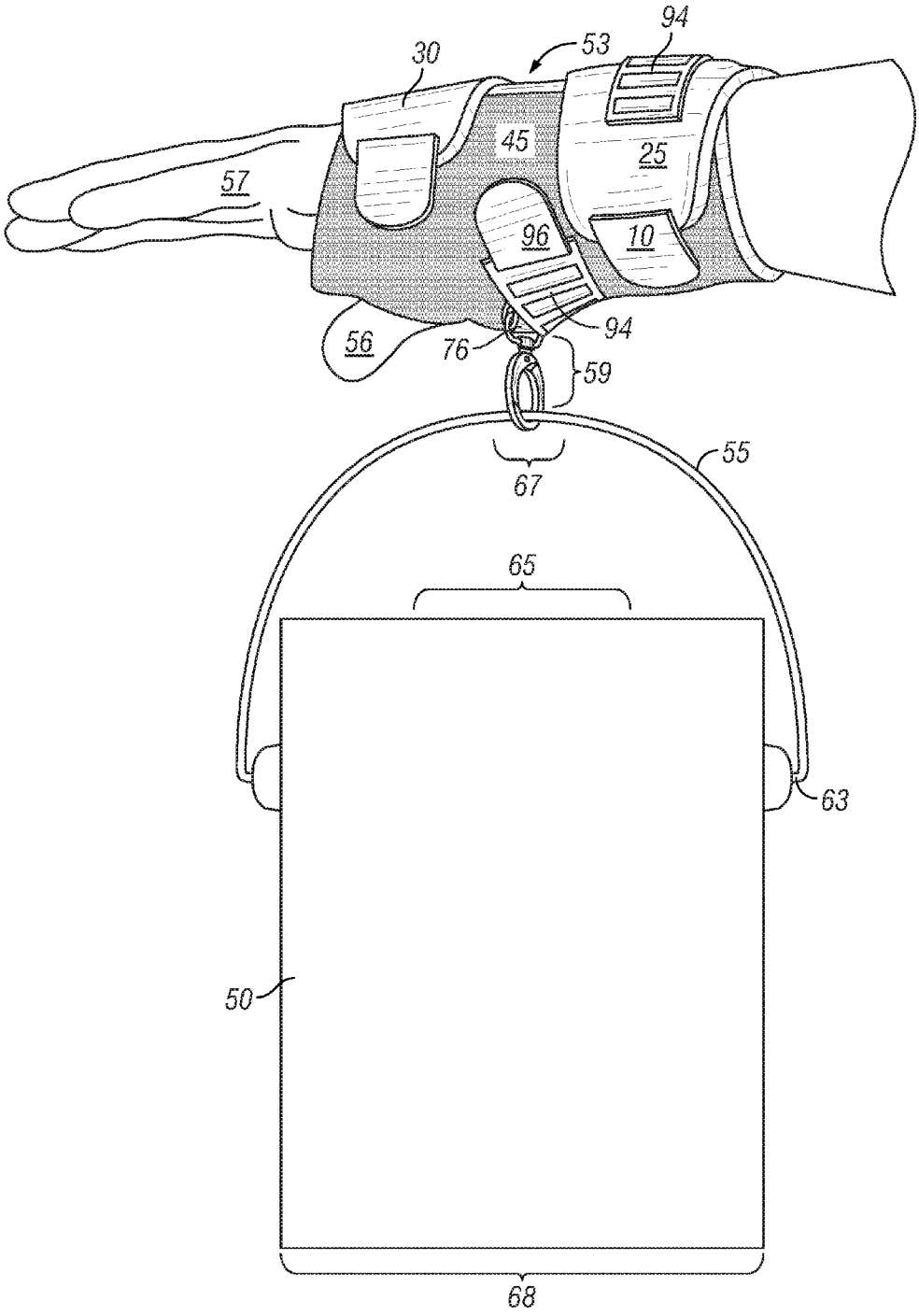
FIG. 10 is a side perspective view where the swivel gate hook is attached to the apex of the semi-circular bale handle of the paint can, the bale handle is engaged in an upright position, and the container is allowed to hang by its own weight and rotate 360 degrees.

Broadly, one embodiment of the present invention, as detailed in FIGS. 1-10, provides a device 5 for one-handed attachment, securing, and controlling of a container 50 exhibiting a u-shaped bale handle 55 where the invention is designed and engineered to facilitate decreased stress and pressure upon the thumb 56, wrist 58, and fingers 57 of the operator. Specifically, the manipulation of the container 50 can be achieved through 1 of 3 variations: palm up, thumb 56 alongside the container 50, fingers 57 beneath container 50, and swivel gate hook 59 attached to the container's 50 u-shaped bale handle 55 at the bale handle apex 67 which is made to rest in downward position close to the container 50 side 60 (as evidenced in FIG. 8), thumb 56 alongside the container 50, fingers 57 resting on the side 60 of the container, and the swivel gate hook 59 connected to the point of attachment and pivot 63 of u-shaped bale handle 55 to container 50 (as depicted in FIG. 9), and thumb 56 and fingers 57 freely moveable, swivel gate hook 59 attached to the u-shaped bale handle 55 at the bale handle apex 67 where the u-shaped bale handle 55 is fully extended upward across the container 50 top 65 and gravitational pull exerting all supporting force on the wrist 58 of the invention operator. As opposed to the traditional expedient but strain inducing method of supporting the container base 68 with the fingers 57 on the base of the container 68 and hooking the thumb 56 about the u-shaped bale handle 55 (not shown), FIGS. 8 and 9 provide an improved container 50 manipulation with painless, secure control of the container 50 while allowing free access to the containers opening 65 and the paint contained within. Additionally, as represented in FIG. 10, the invention operator has the ability and option to attach the swivel gate hook 59 to the u-shaped bale handle apex 67 in its most extended position upward (with thumb 56 and fingers 57 freely moveable) to accomplish other tasks without releasing the container 50. Too, the operator is allowed ease of access to the container opening 65 with a paint brush due to the 360 degree rotation of the swivel gate hook 59.

Figure 1:
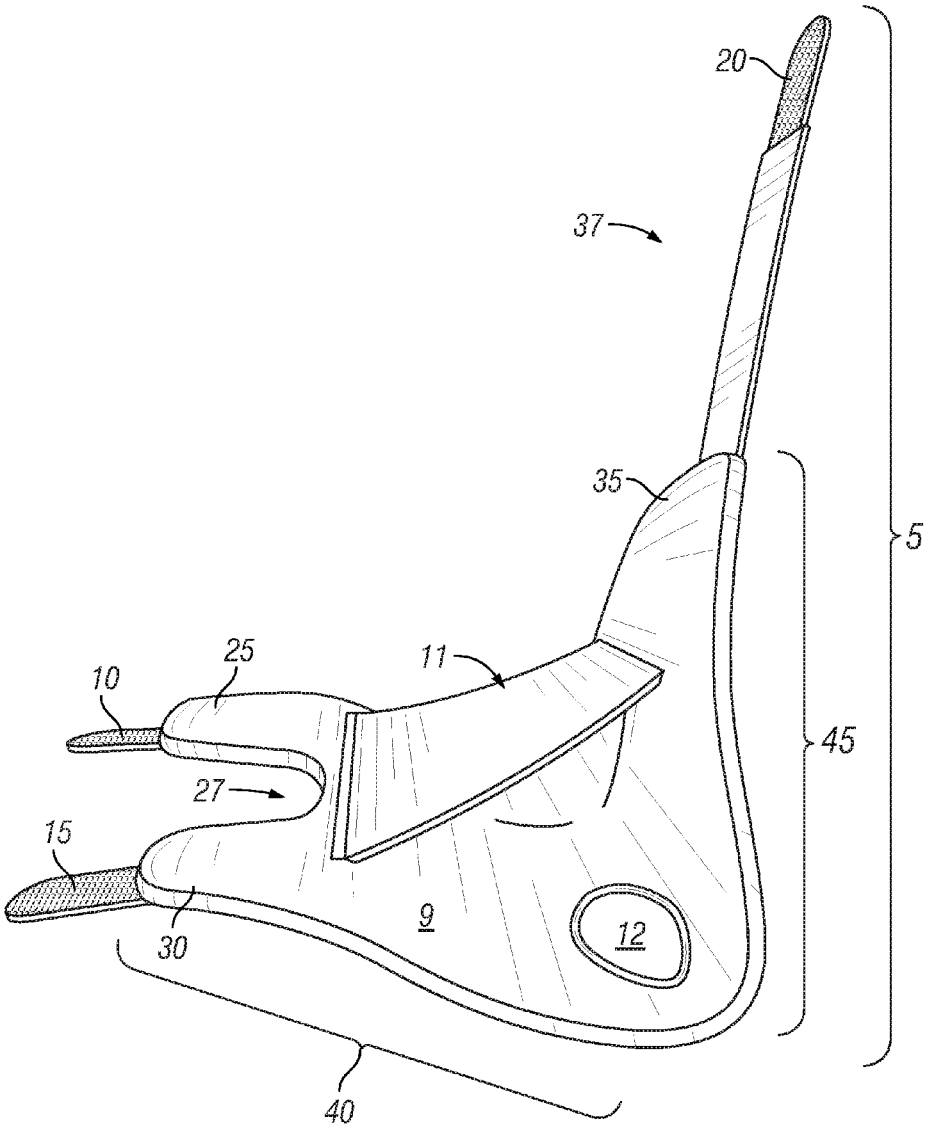
FIG. 1 is a perspective view illustrating the wrist sleeve in an open orientation.
Figure 2:
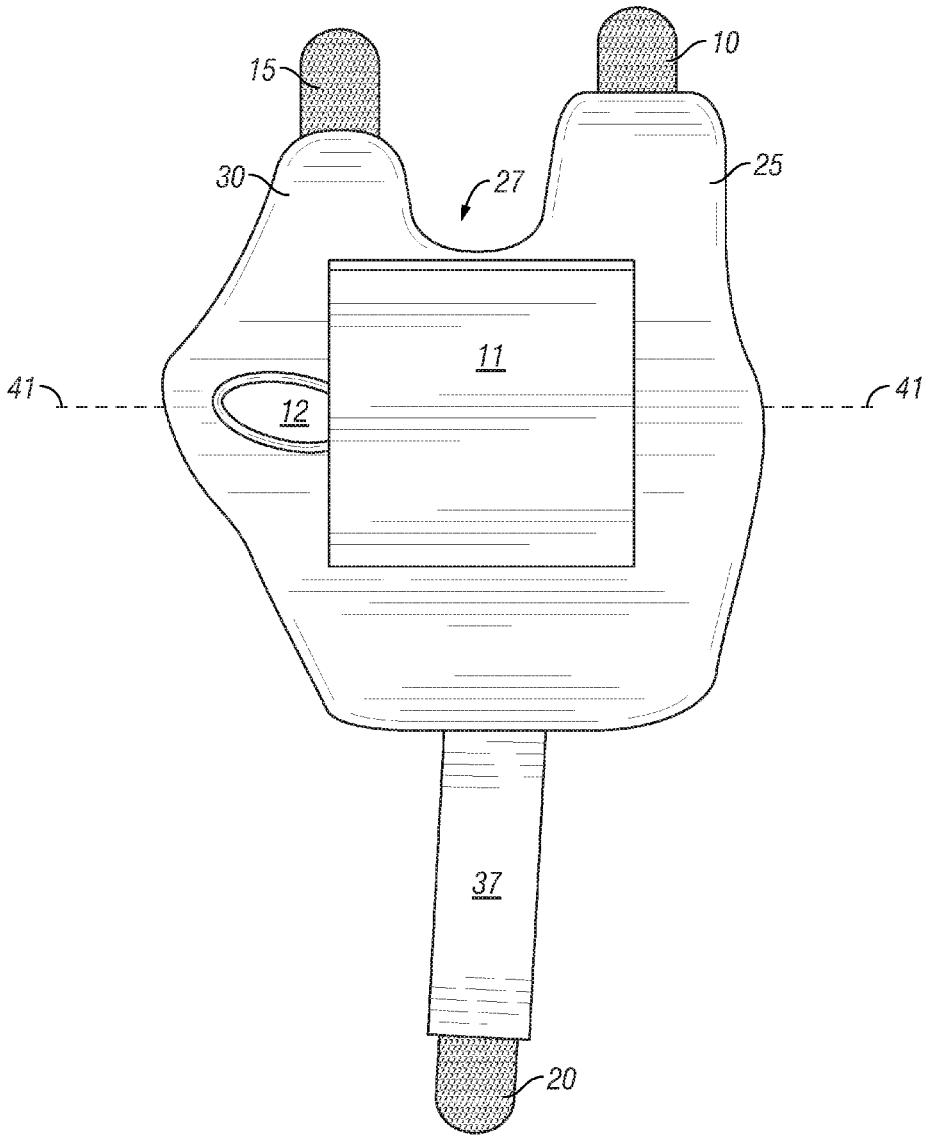
FIG. 2 is a top view of the invention in an open orientation.

FIGS. 1 and 2 show the device 5 in an open orientation where tabs 25, 30, and 35 are pointing out and away from midline 41 where elastic webbing material 11 is tethered to each side of the wrist sleeve 5 and the present invention 5 is made to receive the operator's hand 54, fingers 57 and thumb 56 where the thumb 56 is placed through the orifice 12 that is positioned toward the distal end of the present invention and is bisected by the midline 41 where the orifice 12 is made to appreciate the anatomical configuration an physiological placement of the operator's thumb 56 and the fingers 57 are unrestricted. At the terminal end of tabs 25 and 30 lie hook type fasteners 10 and 15 respectfully where a hook fastener strip 10 is affixed to the outer surface 40 of tab 25 and hook fastener strip 15 is attached to the outer surface 40 of tab 30 at the most distal portion of tabs 25 and 30. As in FIGS. 6 and 7, the tabs 25 and 30 are separated by indention 27 where tab 25 and hook fastener strip 10 extends out and away from the invention midline further than tab 30 and hook fastener strip 15. Opposing tabs 25 and 30 is tab 35 elastic extension 37 and hook fastener strip 20. When side 40 is made to communicate with side 45, hook fastener strip 10 is made to adhere to the exterior loop material portion 43 of side 45, loop fastener strip 30 is made to adhere to the exterior loop material portion 44 of side 45, and hook fastener strip 20 is made to traverse indention 27 and connect to the exterior loop material portion 42 of side 40 via elastic extension 37 creating a circular device 5 that encircles the operator's proximal hand 54, wrist 58, and distal forearm (see FIGS. 8-12).

Figure 3:
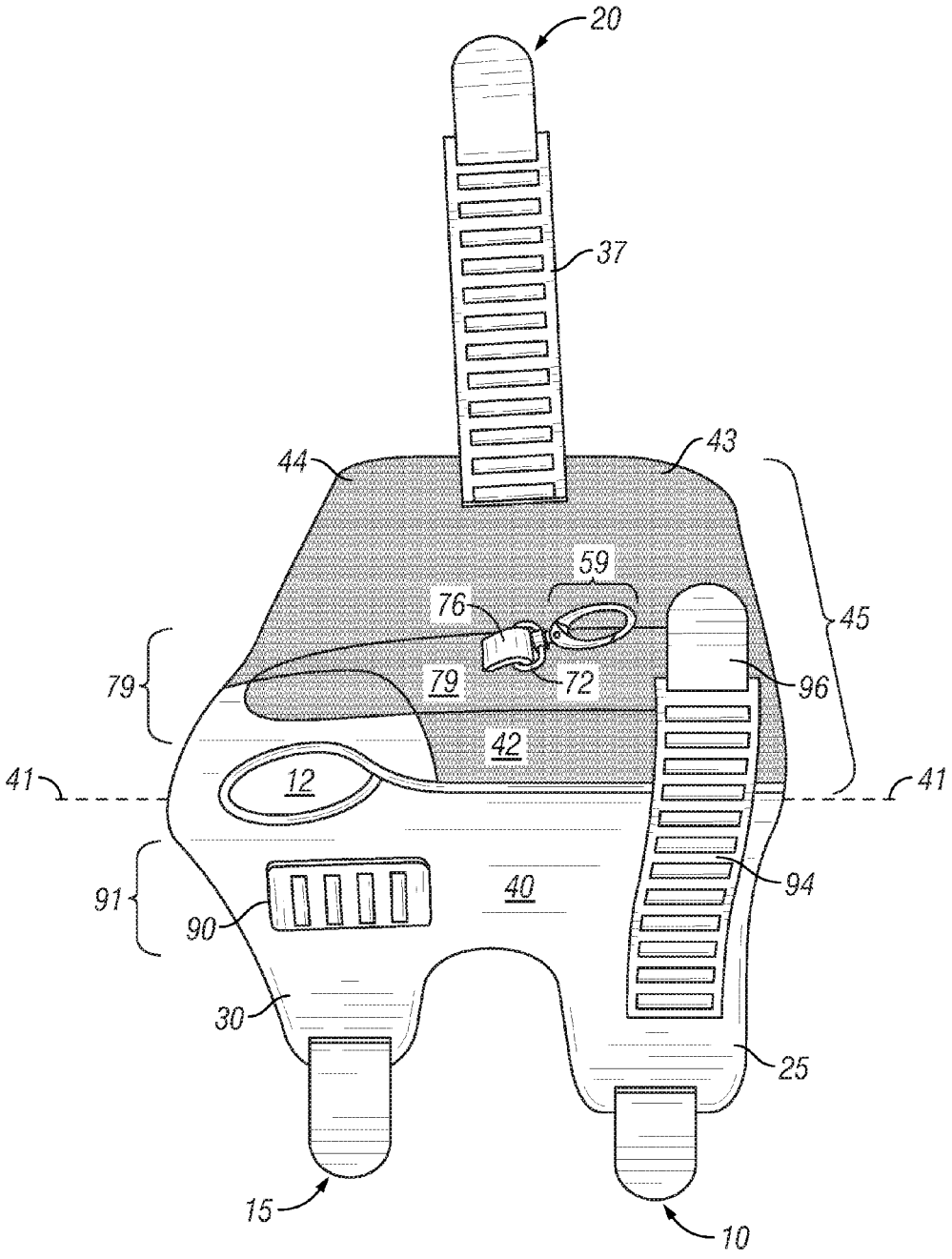
FIG. 3 is an bottom view of the present invention illustrating the engaging means, brush attracting magnet, an means for media device/communication device attachment, and paint can attachment means.

A key component to the present invention is the position and placement of the loop type material 45 as shown in FIGS. 3 and 6. While the interior surface material 9 and the exterior portion material 40 (as shown in FIGS. 3 and 7) can be of varying materials that provide flexible, supportive, and durable qualities (e.g. neoprene), the exterior loop material portion 45 has a unique function in that it is designed to receive each hook fastener strip 10, 15 and 20, releasably and in a number of varying positions and orientations that are user specific. Accordingly, to increase comfort and to allow for adjustment of the present invention hook fastener strips 10 and 15 may be applied and reapplied to outer loop surface 45 at positions 43 and 44 and hook fastener strip 20 may be applied and reapplied to side 40 at loop surface area 42 via elongation of elastic extension 37 innumerable times to accommodate differing wrist 58 and hand 54 dimensions, comfort levels, and duration of use.

Of paramount importance to the functionality of the device 5, too, is the primary functioning member of the present invention that makes up the point of attachment of the wrist sleeve 5 to the container 50 and attached bale handle 55 by the attached swivel gate hook 59 as shown in FIGS. 3, 4, 5, 6, 8, 9 and 10. The attached swivel gate hook 59 draws importance from not only its ability to close securely, but also from the specific position and placement and centering on the center or midline and point of flexion of the wrist 58 which allows the operator the utmost control and ergonomic thumb 56 and finger 57 placement (see FIGS. 8 and 9) and greatest freedom for unencumbered use of the hand 54, thumb 56, and fingers 57 when needed for full two-handed dexterity in painting operations (see FIG. 10).

The point of attachment itself is an egg-shaped push gate swivel snap hook 59 that is securely fastened to the area corresponding with the wrist center and midline 61 but is designed to maintain the ability to move fore and aft along a ¾ inch semicircle strip 76. The ¾ inch semicircle strip 76 itself is securely adhered to the area corresponding to the center and midline of the wrist 58, is sewn onto the "palmer" portion 77 of the device 5 in such a manner that it allows the swivel gate hook's 59 circular eye 72 to move along the entire length of the ¾ inch semicircle strip's 76 length. The circular eye 72 harbors a circular opening (not shown) that bisects the circular eye 72 and is made to receive the egg-shaped push gate swivel snap hook post (not numbered) thus allowing for freely moveable and independent rotation (see FIGS. 3, 4 and 6).

Figure 4:
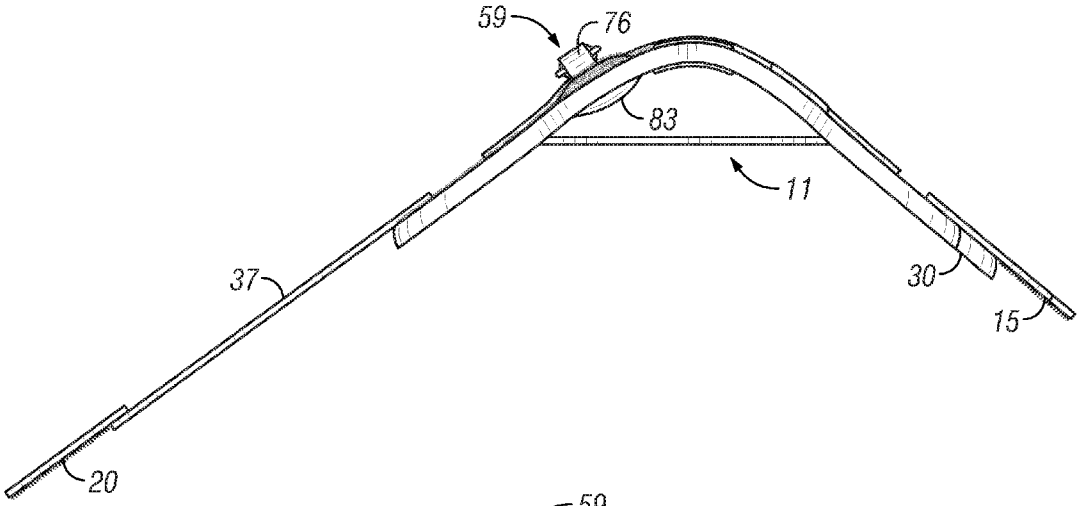
FIG. 4 is a front view of the present invention in an open orientation.
Figure 5:
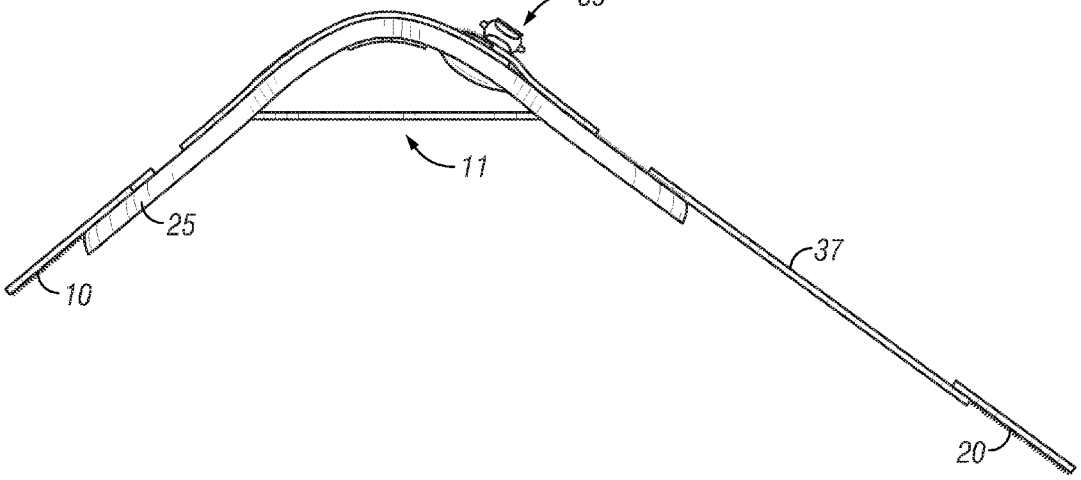
FIG. 5 is a rear view of the present invention in an open orientation.
Figure 11:
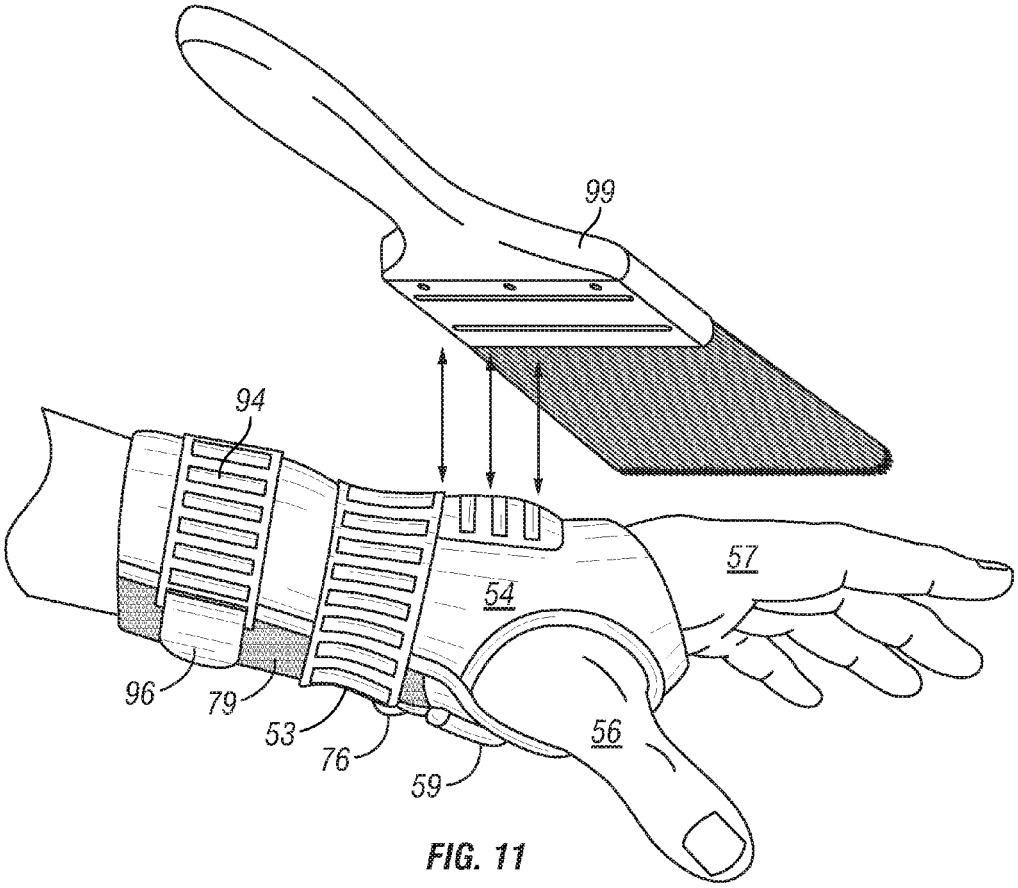
FIG. 11 is a side view depicting brush attachment.
Figure 12:
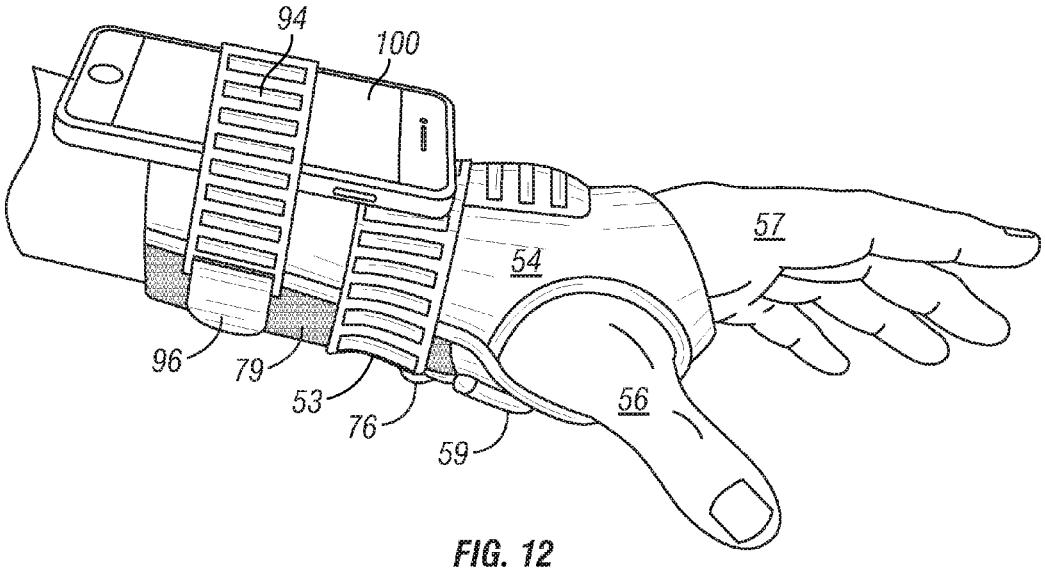
FIG. 12 is a side view depicting communication/media device attachment.

In addition to those components that are germane to the functionality of the present invention, there are several features that add either comfort or usefulness. In the area of comfort, a comfort strip 79 (as depicted in FIGS. 3, 6, 8, and 9) is sewn into the device 5 along the palmer, midline of the forearm and wrist that runs the length of the device 5, tapers at either end, and rises above and below the plain of the both the outer and inner portions of the device 5 (as shown in FIGS. 4 and 5). Structurally, this comfort strip 79 serves the dual function of operators wrist support internally 83 and container bottom 68 support externally 84. Turning to utility, the device 5 that is the present invention displays 2 innovative improvements on the external portion 84 that aid in the attachment of devices used by virtually each and every painter: a brush and a media/communication device. As shown in FIGS. 3, 7, and 9, a magnet 90 is located on the dorsal region 91 of the device 5 in an area distally fixed and most closely associated with the back of the hand 58. The magnet 90 can be made to attract and reversibly adhere to metal objects up to and including a painter's brush (as shown in FIG. 11). Additionally, the present invention exhibits an elongated elastic strip 94 that is made to run perpendicular to the operators forearm. This elongated elastic strip 94 has to it attached a terminal tab 96 with a hook fastener strip placed underneath (not shown) that is made to attach to loop fastener portion 45 of the device 5. The elongated strip 94, demonstrates a novel utility of fastening to the device 5 a media and/or communication device (as demonstrated in FIG. 12) with which the wrist sleeve operator can have ready access to a wide array of multi-media while experiencing hands-free communication.

It should be understood, of course, that the foregoing description is illustrative only and is not limited to the specific construction and arrangement as displayed and described and that the present invention representation relates to exemplary embodiments of the invention. Further, modifications as to position and placement up to and including a mirror image, reconfiguration of tabs and hook and loop type fasteners, attachment placement, magnetic holder position and placement or media and/or communication device position and placement may be made without departing from the spirit and scope of the invention. Accordingly, the invention is best described and defined as set forth in the following claims.

I claim as my invention:

1. A device in the form an adjustable wrist sleeve designed to receive and attach to a cylindrical container with a semi-circular bale handle that allows for painless, one-handed control and manipulation of the container, said device comprising:

a primary u-shaped body, a circular opening for the insertion of a thumb bisected by the vertical axis of the u-shaped body toward the distal end of the u-shaped body in an area corresponding to the anatomical placement of the thumb, an elastic arm-fixing inner sleeve attached to either side of the u-shaped body at a point approximately one-half the distance between the u-shaped body vertical axis and the u-shaped body's outer edges which is made to run parallel to the u-shaped body's vertical axis, a plurality of securing tabs for the reversible opening and closure of the wrist sleeve, and a freely rotatable, reversibly opening and closable gate snap hook that is the point of attachment between the device and a cylindrical container exhibiting a semi-circle bale handle.

2. The device of claim 1, wherein:

said primary u-shaped body exhibits 2 halves composed of Neoprene® or a similarly acting material where the lateral top side, corresponding to the dorsal side of the hand, is a naked material and the bottom side, corresponding to the bottom/palmer hand, wrist and medial forearm side is covered in a loop-type fastener material.

3. The device of claim 1, where:

said securing tabs consist of 2 tabs that are constructed of hook type fasters stationed and attached to the outermost edges of the wrist sleeve side that is made to cover the top of the operator's hand, wrist, and lateral forearm, run transverse to the operator's arm, and move out and away from the operator's midline to communicate with the corresponding loop type material covering the bottom half of the u-shaped wrist sleeve facilitating wrist sleeve closure.

4. The device of claim 1, where:

the area between the 2 securing tabs on the outermost edges of the wrist sleeve side that is made to cover the top of the operator's hand, wrist, and lateral forearm displays a recession in the form of an absence of material or crevasse that is made to facilitate the reception of an opposing securing tab.

5. The device of claim 1, wherein:

a securing tab displaying hook type fasteners which is attached to an elastic extension connected to the opposite medial wrist sleeve side and runs in between and in opposition to the 2 top attached tabs and is made to reversibly adhere to the loop type material of the bottom half of the u-shaped wrist sleeve facilitating wrist sleeve closure.

6. The device of claim 1, where:

a securing tab constructed of an elastic extension and a hook type fasteners tab is attached to the most proximal, upper portion of the wrist sleeve, is made to run transverse to the operator's upper arm and across the forearm of the operator for securing of a media and/or communication device to said wrist sleeve.

7. The device of claim 1, where:

a metal attracting magnet is sewn onto the wrist sleeve device atop the sleeve and in a position that most closely approximates the back of the hand of the operator and is made to receive the magnetic ferrule of a paint brush or other metallic objects for hands free brush or other metal object deposition.

8. The device of claim 1, where:

a padded comfort strip insert is sewn into the wrist sleeve device that runs parallel to the operator's wrist along the palmer, midline of the forearm, is tapered at either end of the wrist sleeve device, runs under said gate snap hook, and extends above and below the plain of the wrist sleeve serving the dual purpose of operator wrist support and a barrier between container base externally and operator's wrist and forearm internally.

9. A method of single-handed, fixed controlling and manipulation of a container by an operator comprising the steps of:

providing a device comprising a primary u-shaped body, a circular opening for the insertion of a thumb bisected by the vertical axis of the u-shaped body toward the distal end of the u-shaped body in an area corresponding to the anatomical placement of the thumb, an elastic arm-fixing inner sleeve attached to either side of the u-shaped body at a point approximately one-half the distance between the u-shaped body vertical axis and the u-shaped body's outer edges which is made to run parallel to the u-shaped body's vertical axis, a plurality of securing tabs for the reversible opening and closure of the wrist sleeve, and a freely rotatable, reversibly opening and closable gate snap hook that is the point of attachment between the device and a cylindrical container exhibiting a semi-circle bale handle inserting the operator's hand and arm into the device;

rotating the semi-circle shaped bale handle into a downwardly positioned location toward a bale handled container's side;

clasping the freely rotatable, reversibly closable gate snap hook to the apex of the bale handle at an area corresponding to the operator's wrist;

positioning operator's thumb on the lower side of the container; and placing operators fingers on the container bottom thereby supporting container weight.

10. The method of single-handed, fixed control of a paint container, as claimed in claim 9 wherein:

the semi-circle shaped bale handle is downwardly positioned toward the bale handled container's side;

the freely rotatable, reversible closable gate snap hook is engaged at the point of attachment and pivot of the bale handle at an area corresponding to the operator's wrist; and the operator's thumb, palm, and fingers are placed on the side of the container to support and manipulate the container.

11. A method of single-handed controlling and manipulation of a container by an operator comprising the steps of:

providing a device comprising a primary u-shaped body, a circular opening for the insertion of a thumb located at the vertical axis of the u-shaped body toward the distal end of the u-shaped body, an elastic arm-fixing inner sleeve affixed to either side of the u-shaped body at a point approximately one-half the distance between the u-shaped body vertical axis and the u-shaped body's outer edges which is made to run parallel to the u-shaped body's midline, securing tabs for the reversible closure of the wrist sleeve, and a freely rotatable, reversibly closable gate snap hook that is the point of attachment between the device and a cylindrical container exhibiting a paint can bale handle positioning the semi-circle shaped bale handle in an upwardly position;

clasping the freely rotatable, reversibly closable gate snap hook to the apex of the bale handle and making the clasp receive the balanced weight distribution of the container from the area of operator's wrist while allowing the operator unlimited access to the container through 360 degree rotation, and unrestricted and unencumbered use of operator's hand, thumb and fingers.

* * * * *